United States Patent [19]

Hofmann

[11] 4,423,606

[45] Jan. 3, 1984

[54] METHOD FOR MECHANICAL STITCH FORMATION AS WELL AS KNITTING MACHINE FOR CARRYING OUT THE METHOD

[76] Inventor: Ulrich Hofmann, Herderstr. 99, D-7470 Albstadt 1, Fed. Rep. of Germany

[21] Appl. No.: 129,366

[22] Filed: Mar. 11, 1980

[30] Foreign Application Priority Data

Mar. 14, 1979 [DE] Fed. Rep. of Germany ..... 2909963

[51] Int. Cl.[3] ..... D04B 9/02; D04B 7/00; D04B 35/02

[52] U.S. Cl. ..... 66/13; 66/62; 66/116; 66/123

[58] Field of Search ..... 66/13, 62, 120, 121, 66/8, 90, 116, 123

[56] References Cited

U.S. PATENT DOCUMENTS

| | | | |
|---|---|---|---|
| 47,852 | 5/1865 | Otis et al. | 66/13 |
| 61,630 | 1/1967 | Miller et al. | 66/13 |
| 1,035,752 | 8/1912 | Scott | 66/120 |
| 1,096,945 | 5/1914 | Pope et al. | 66/120 X |
| 1,321,552 | 11/1919 | Randall | 66/120 |
| 1,333,156 | 3/1920 | Burson | 66/13 |
| 1,441,592 | 1/1923 | La Montagne | 66/120 X |
| 1,634,423 | 7/1927 | Hull | 66/13 |
| 1,652,308 | 12/1927 | Howie | 66/90 X |
| 1,673,634 | 6/1928 | Page | 66/13 |
| 1,877,503 | 9/1932 | Gagne | 66/123 X |
| 2,441,662 | 5/1948 | Fontaine | 66/121 |
| 3,952,551 | 4/1976 | Kohl | 66/120 |
| 4,191,033 | 3/1980 | Sommer | 66/121 X |

FOREIGN PATENT DOCUMENTS

| | | | |
|---|---|---|---|
| 2245842 | 3/1974 | Fed. Rep. of Germany | 66/116 |
| 2604433 | 8/1977 | Fed. Rep. of Germany | 66/116 |
| 47-7746 | 4/1972 | Japan | 66/120 |
| 3774 | of 1880 | United Kingdom | 66/13 |
| 7196 | of 1894 | United Kingdom | 66/13 |
| 314834 | 12/1971 | U.S.S.R. | 66/121 |

*Primary Examiner*—Wm. Carter Reynolds
*Attorney, Agent, or Firm*—Shlesinger, Arkwright, Garvey & Fado

[57] ABSTRACT

A knitting machine comprising a needle bed and a plurality of grooves in the needle bed for receiving knitting needles with a hooked knitting needle positioned in each of the grooves. Each of the knitting needles has an associated plate guided in the same groove. The plate includes a longitudinally extended finger directed toward the hook of the needle. The needle includes a shank portion having a recess therein below the hook of the needle for receiving the finger of the plate with the plate being moveable longitudinally and transversely with respect to the needle for widening a stitch formed therearound.

10 Claims, 36 Drawing Figures

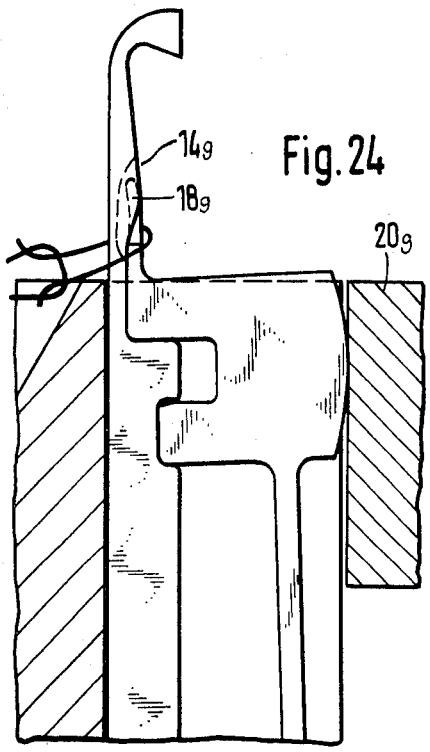
Fig. 24
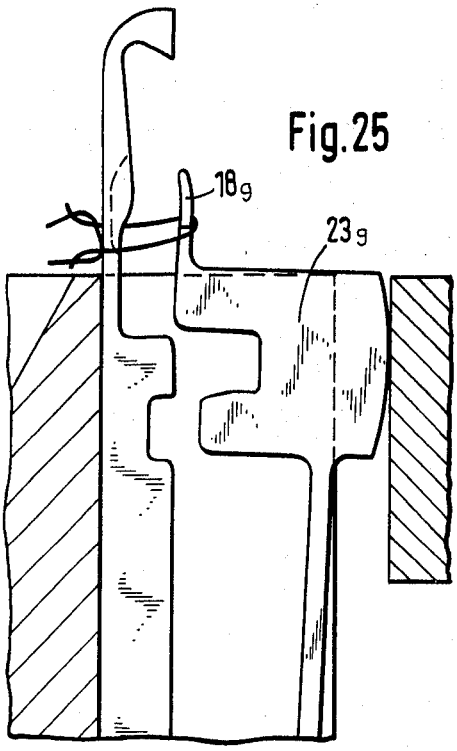
Fig. 25
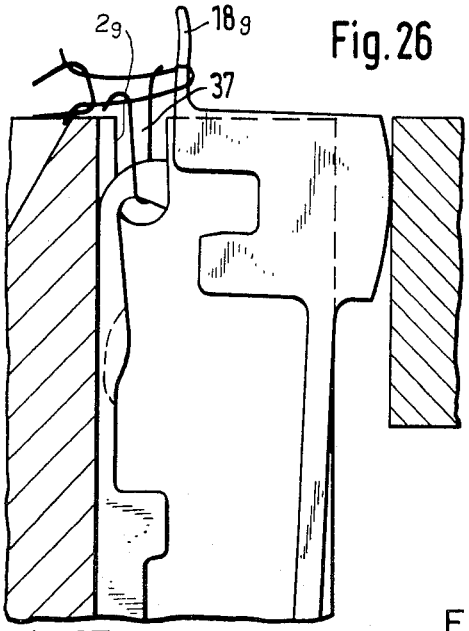
Fig. 26
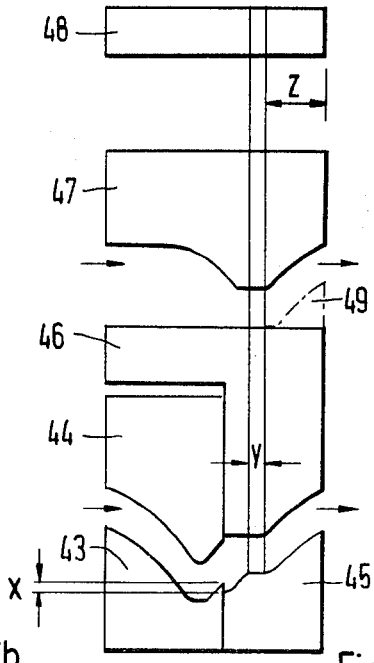
Fig. 27
Fig. 27a
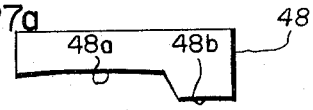
Fig. 27b
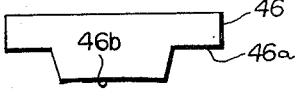

METHOD FOR MECHANICAL STITCH FORMATION AS WELL AS KNITTING MACHINE FOR CARRYING OUT THE METHOD

The invention concerns a method for mechanical stitch formation with at least one continuous thread, where the thread is moved through the previously formed stitch as a loop by means of a knitting needle, and a new stitch is formed, which subsequently is widened substantially to its final stitch size in the plane of the previously formed stitch and is held from the inside by the hook of a plate until the next caught up thread arrives in the area of the stitch plane at the beginning of loop formation.

In the case of the method this type known from U.S. Pat. No. 2,560,872, as with the other similar stitch formations, the last formed stitch is formed and widened to the required stitch size, in order to create space for pulling through the thread forming the next loop or stitch. After this, when the new stitch hangs on the hook neck of the needle, the needle is thrust forward, whereby the stitch moves from the narrower needle neck along a gradual ascent to the needle front with a widened circumference. Since more rapid needle movements are necessary to increase the operating efficiency, and in order to avoid impermissible thread stresses, the widening of the stitch may take place only gradually on the needle front, the result is necessarily a relatively large lengthwise stroke of the stitch forming element. In the case of latch needles, the widening of the stitch located on the needle is continued until release, when it glides away over the latch which is closed with the withdrawal movement of the needle. However, the known method works with a latchless needle and due to this shortens the needle stroke by a certain fraction of the length, which in the case of a latch needle extends between the hinge and the end of the opened latch. Instead of this, an upward directed hook of a plate within a groove of the needle shaft engages in the stitch which is widened on the needle front, in order to take it over and to hold it until the downward directed passage movement of the needle hook with the next thread is completed.

But low limits with regard to the achieveable efficiency are set on the method practiced with the known machine not only by the relatively large needle stroke, but also with regard to fineness of mesh. This is to be attributed to the fact that according to experience stitch formation elements with hook thickness of less than 0.3 mm cannot be carried out or are not stable enough. This minimum dimension of course also applies for plates and their hooks, from which it follows that a fine needle, whose shaft contains a groove for shiftable uptake of the plate hook, necessarily must be twice as thick as the plate and therefore the mesh or stitch number per unit of surface is limited.

The necessity of sinking the plate hook completely in the groove of the needle front in order to be able to take over the stitch onto the plate hook is also disadvantageous with the known machine. The smaller thickness of the plate hook with respect to that of the needle makes the pulling of the new thread through the stitch hanging on the plate hook more difficult. Even more difficult for the safety of the stitch formation process within the few available milliseconds is the danger that the stitch held fast under stress on the plate hook will be pulled into the relatively wide channel of the needle bed with the upward movement of the plate intended for release, and before it slides out under the effect of the product withdrawal, it remains in the area of the needle head and can be picked up again during the next thrust movement. The safety of the stitch formation process requires however that the released stitch arrive right behind the needle for sinking the loops.

It is the object of this invention to thoroughly improve a method of the type considered at the outset, which makes possible an increase in the number of stitches achievable per unit of time with the same stitch quality and with increased mesh fineness (at least the same mesh height with greater mesh density) and moreover a greater reliability of the stitch formation process is achieved, and indeed with reference to the safety that the released stitch will arrive behind the needle head before or during the knocking over and the already finished fabric will not be taken along with the thrusting forward again of the needle.

In the case of needles with a very flat front ascent for single area fabrics (single machine) it is known how to provide plates between the needles, which prevent upward movement of the fabric when the needle is thrust forward. The stitch row would be changed with one single such process, and the uniformity of the stitch formation is destroyed. The plates used here hold the stitches back when the needles are thrust forward, and they increase the spacing and limit the fineness of the fabric.

According to the invention, these disadvantages are corrected and the aforementioned problem is solved by the fact that the stitch surrounding the needle shaft and the plate hook is widened by relative movement of needle and plate in a directed essentially parallel to the stitch plane, and that subsequently both stitch formation elements are moved individually vertical to the stitch plane to pull through the new loop and to release the widened stitch. An important differing feature of this proposal compared to the state of the technology consists in the fact that previously the stitch was widened during the upward advancement of a wedge-shaped front of the needle shaft therethrough, while the present invention provides for stitch widening after completion of the upward advancement of the needle, so that the stitch widening takes place quite independantly of the longitudinal work cycle of the needle shaft, thereby eliminating stresses in the thread of the fabric. The forward thrust movement of the needle and the needle stroke can be considerably shortened for this reason, which makes possible higher operating speeds. The widening of the stitch to its final size takes place after thrusting forth of the needle through a relative movement of needle and plate or their transport hook running transverse to needle lengthwise direction. Such a widening process takes place without problem, since widening forces occur only in the stitch plane and friction influences have no effect, so that the newly formed, widened stitch remains in the general stitch plane until knocking over of the stitch, without the need for special plates between the needles.

With the method according to the invention, the uniformity of the widening and the uniformity of the thereby occurring thread stress are improved to such an extent that after the relative movement of the plate hook and the needle shaft transverse to the lengthwise needle stroke, the widened stitch remains in its widened state during a relatively long section in the cycle of stitch formation, and indeed during the capture and pulling through of the next thread during the upward movement of the needle and also during the following downward movement of the plate, until the plate hook has left the knocking over or stitch plane. Therefore, the external forces working on the thread and on the stitch formation and whose effects can be precisely determined because of the very rapidly occurring phenomena, can be reduced to a minimum, which is helpful for the uniformity of the originating mesh goods.

A knitting machine for carrying out the previously described method, whose needles are present in the area of the mesh plane on the front side of the needle shaft are assigned to a plate provided with an upwardly directed transport hook, holding the stitch until the next loop formation, is characterized by the fact that the needle neck behind the needle shaft adjoined to the hook contains a recess for taking up the transport hook of the plate, which forms a stitch forming element controlled independently of the needle, and when there is a coupling between the recess and the transport hook, is guided lengthwise with the needle and likewise is movable for performing a controlled relative movement running transverse to the needle lengthwise movement.

According to the invention, a plate controlled by the knitting machine, which is conducted in front of the front part of the needle shaft in the same needle channel, is provided with a transport hook, which engages in the recess of the needle shaft and can form the continuation of the needle neck up to a lower stop edge. Preferably, the transport hook engaging in the recess forms a somewhat rectilinear continuation of the front edge of the neck section. The plate with the transport hook is controlled for performing the lengthwise and transverse movement, whereby after taking up the last stitch head on the needle neck and coupled transport hook, the stitch is widened by the transverse transport of the plate, and is released after pulling through of the new thread with the sloughing of the stitch.

In one version of the invention, the plate can exhibit a shaft which extends along the needle shaft, and according to the type of counterpoise bearing arrangement, is supported on the needle shaft by sliding areas arranged on both sides of the counterpoise bearing and can be controlled by sliding guides of the machine in its transverse movement to the needle shaft. Thus the transverse movement is controlled over the counterpoise bearing and the lengthwise movement of the plate is controlled over a foot arranged in the shaft, for example in a conventional locked curve.

According to a preferred design form of the invention, the plate can be connected with the plate shaft by means of a spring part and can be prestressed in open position (knitting position), in which the transport hook stands at a lateral interval from the recess of the needle shaft. The control of the transverse movement is accomplished here also by means of a sliding guide engaging on the plate, with which the transport hook is moved into the recess in the needle shaft against the spring tension.

The invention also includes a design form in which the plate connected with the shaft by the spring part is prestressed with the transport hook in a spring loaded manner for engagement in the recess in the needle shaft and thus in its catch position. In this case the plate has a nose in which a sliding guide engages, in order to move the plate against the spring effect in the open knitting position with regard to the needle shaft.

The passage of the newly formed stitch from the neck of the knitting needle to the transport hook of the plate has great importance for the perfect functioning of the stitch formation according to the invention. It is clear from the figures that the recess in the needle shaft is arranged as a length wise groove in a lengthened section of the needle neck and that the upper section of the plate does not exhibit the entire needle thickness, so that the transport hook can engage in the groove.

Especially to achieve finer spacings, according to another proposal of the invention the plate can be manufactured massively throughout as a finely punched part and the transport hook can exhibit the same thickness as the needle. When pulling the plate through with the transport hook to release the last stitch, this can no longer be drawn laterally into the needle channel; rather it is moved away into the rebound plane by the transport hook which is moving back. Since no hinge is present or necessary on the needle, still finer needle thickness and spacings are possible than in the case of the previously known stitch forming elements.

In order to guarantee the transfer of the stitch from the needle neck to the transport hook in a sure manner, it is proposed that the recess in the needle shaft exhibit an obliquely running boundary wall at least on its end directed to the hook, on the path of which the front end of the transport hook is additionally adapted for the purpose of a complete untake in the recess.

According to a variation, a short groove can be made in the recess arranged in the neck prolongation in the direction to the needle hook, while the plate exhibits a transport hook tapered on one end, with which it is completely taken up in the groove. The transport hook can run tapered or pointed on its end and can be slightly bent in the direction of the groove base.

In addition to the separate controls of the needle and the plate over lock curves engaging on their feet, according to another proposal of the invention, coupling sections can be provided which mesh mutually in the case of rectified movement directions, for example in the form of a projection with an upper shoulder on the needle shaft and with a recess in the plate, whose flank is then located in the path of the projection shoulder, when the plate is driven to its transverse movement directed in catch position.

In order to make possible all the basic operations necessary for providing knit patterns in the knit fabrics, operations such as knitting, not knitting, tuck stitching and transfer stitching on other needles for which a coupling of needle and plate is necessary not only in one, but also in the other stroke direction, the coupling sections between plate and needle shaft can have at least one projection and at least one recess for a mutually toothed engagement. The flanks or shoulders of the projections and recesses can actually be bevelled. The invention can be used in the case of circular and flat knitting machines for a single and double-surface fabric, and also for loop sinking and chain knitting machines.

Figure 4:
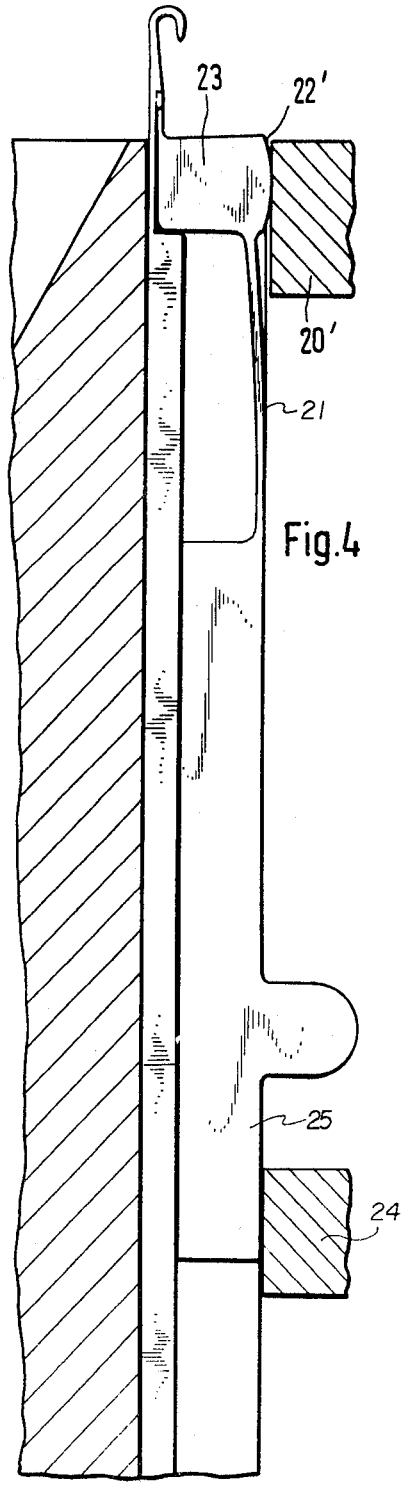
Figure 5:
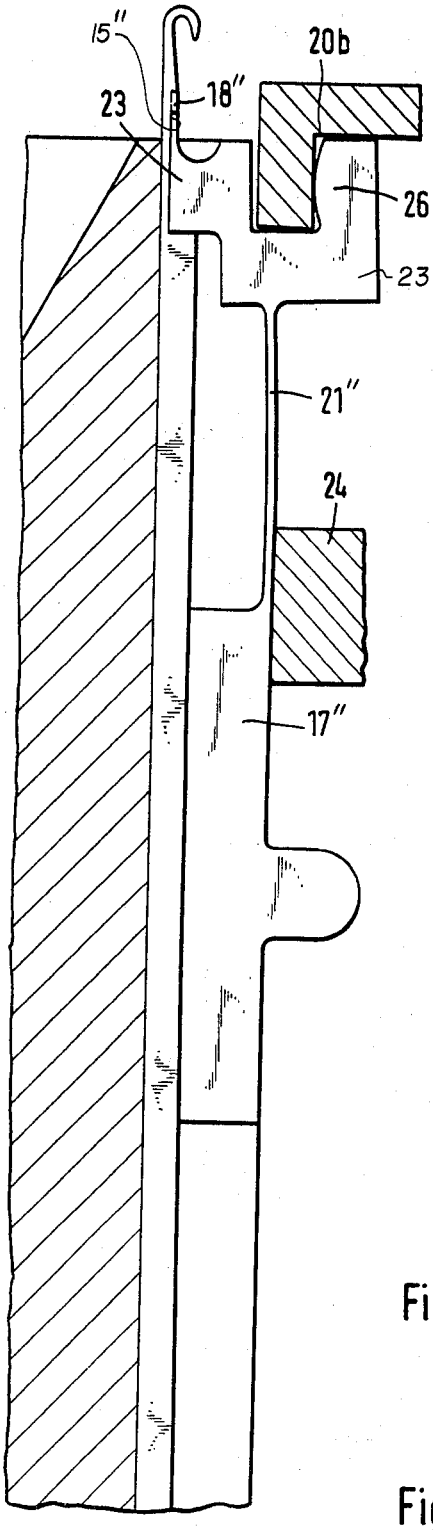
Figure 6:
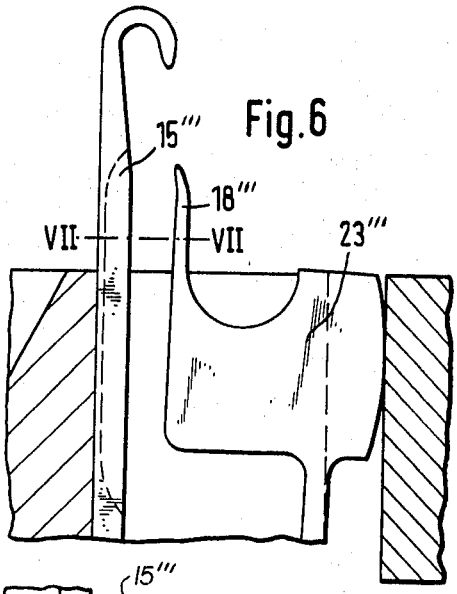
Figure 7:
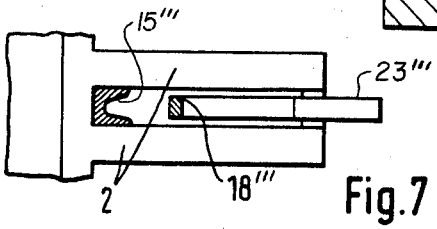
Figure 8:
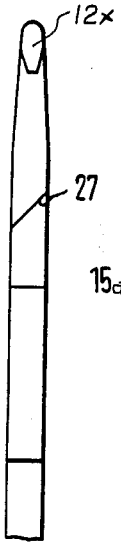
Figure 9:
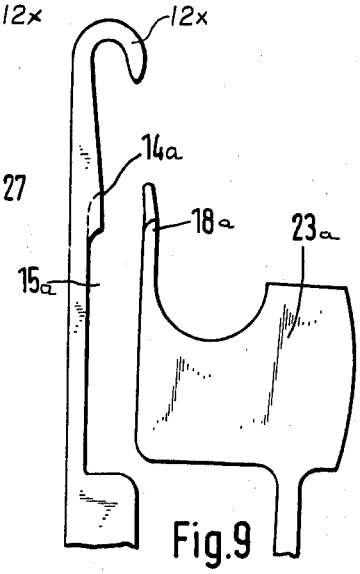
Figure 10:
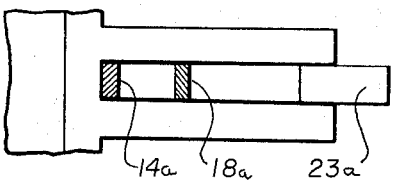
Figure 11:
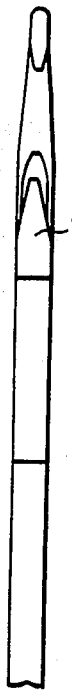
Figure 12:
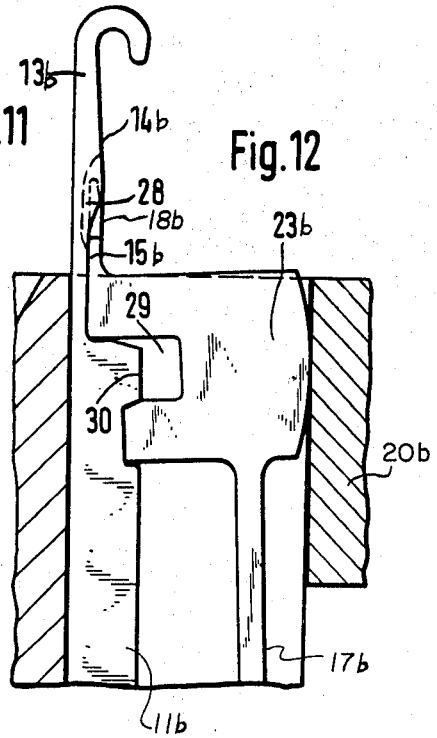
Figure 13:
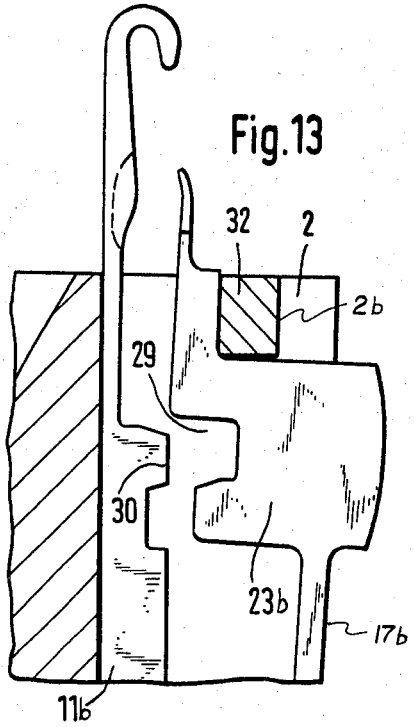
Figure 14:
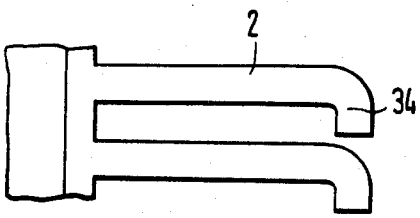
Figure 15:
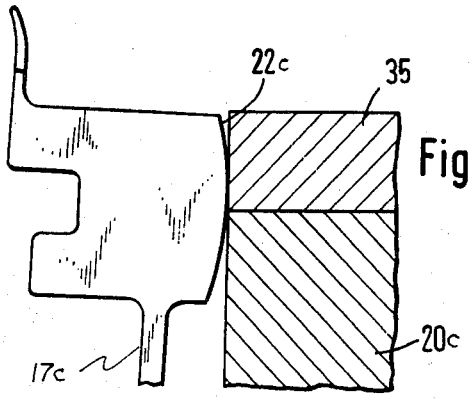
Figure 16:
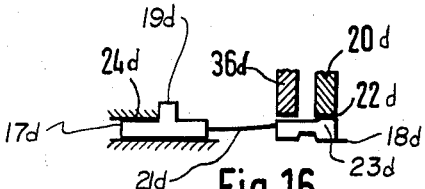
Figure 17:
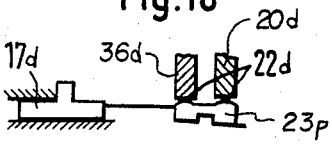
Figure 18:
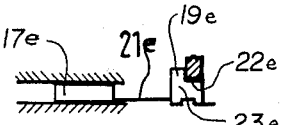
Figure 19:
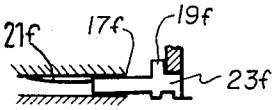
Figure 20:
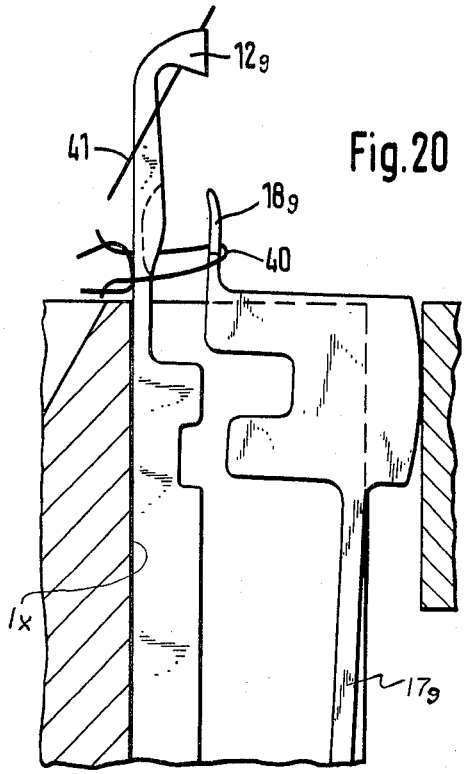

FIG. 5 is an enlarged side view of a variation of the device of FIG. 4 with the plate prestressed in closing or catching position, FIGS. 6 and 7 are respectively a plan view and a cross section view along line VII-VII in FIG. 6 of an alternative embodiment of a needle shaft with recess in the form of a lengthwise groove and a plate adapted to it, FIGS. 8, 9 and 10 are respectively a plan view, a side view and top view in section of a variation of the meshing connection of FIGS. 6 and 7 between transport hook and plate and recess in the needle shaft, FIGS. 11 and 12 are respectively views similar to FIGS. 8 and 9 of another possibility for the mesh and placing of the transport hook in the recess of the needle shaft, FIG. 13 is an alternative embodiment of the device of FIG. 12 showing a partially sectional side view through a needle bed needle and plate illustrating a limiting rail for the spring path of the plate, FIG. 14 is a schematic top view on an area of the needle bed with spring path limiting devices, FIG. 15 is a fragmentary side view of a transport hook with another spring path limiting mechanism, FIGS. 16 and 17 are plan views of two sliding guides and sliding sites for the purpose of broadened design possibilities, FIGS. 18 and 19 are plan views of another design form of plates according to the invention, FIGS. 20 to 25 are schematic views showing the method steps of the stitch forming process according to the invention, FIG. 26 is lengthwise cross section view through the needle bed with upper recesses in the crosspiece or needle channels open above, whereby the function of the crosspieces otherwise forming the needle channel is taken over by the stitch hanging on the transport hook, FIG. 27 is a schematic view of the lock parts for controlling the needles and plates for a system, FIG. 27*a* is a top plan view of the sliding guide element 48 of FIG. 27.

Figure 31:
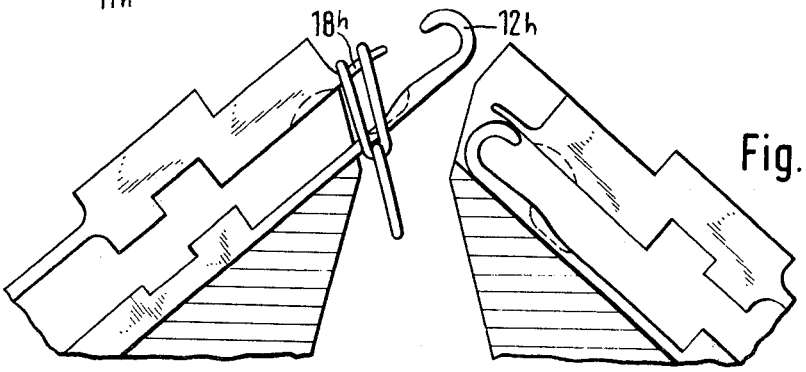
Figure 32:
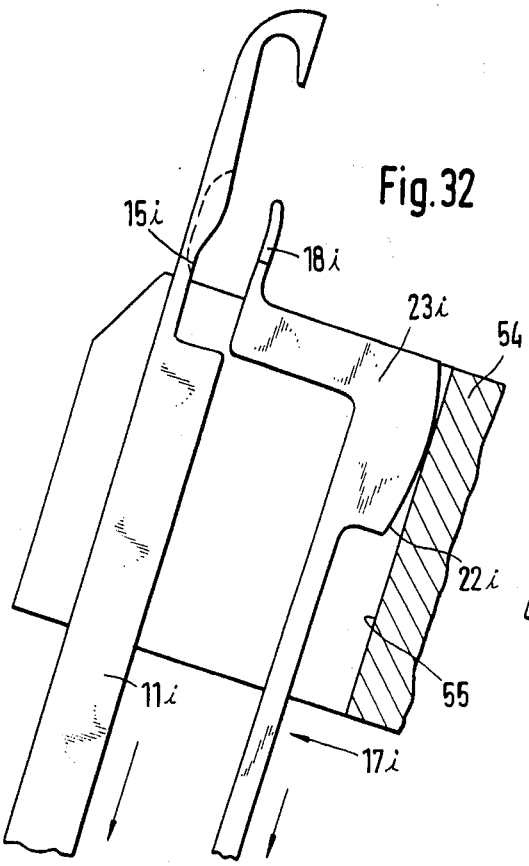
Figure 33:
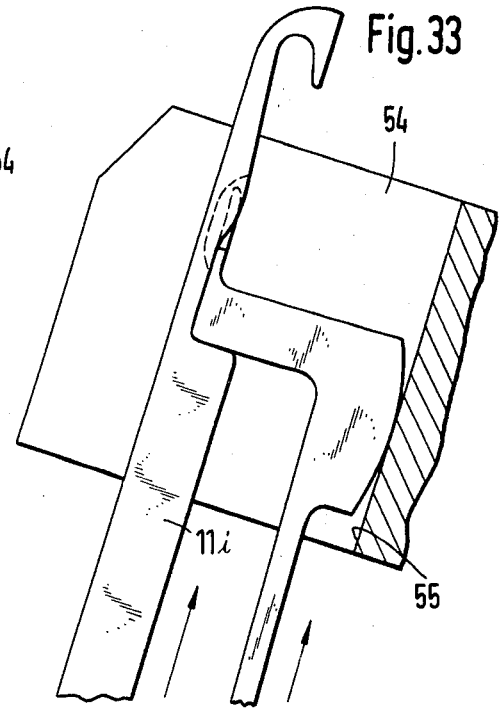
Figure 34:
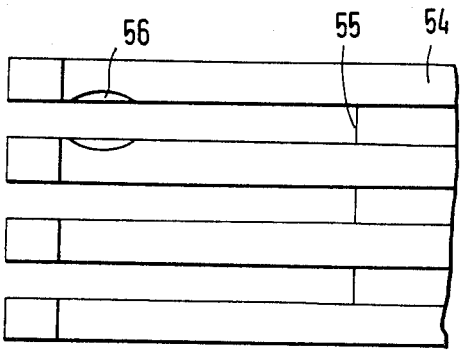
Figure 35:
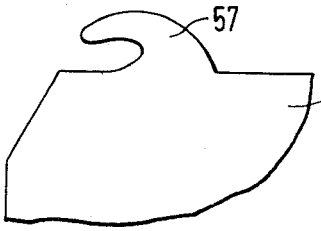
Figure 36:
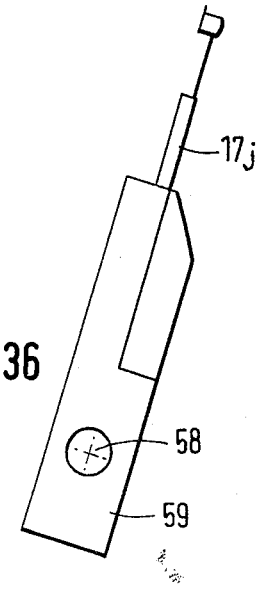

FIGS. 28 to 31 are views similar to FIG. 27 showing a succession of steps for explaining the taking up of a stitch with flat knitting machines, FIGS. 32 to 33 are schematic views of a stitch forming element according to the invention for use with a chain knitting and loop sinking machine, FIG. 34 is a top view of a knocking over comb with pressed surfaces for the sliding area of the plate according to FIGS. 32, 33, FIG. 35 is a schematic view of another design of the upper side of the knocking over comb according to FIG. 34 and FIG. 36 is a schematic view of a plate arranged on a swivelling bar for the purpose of transverse movement.

Figure 1:
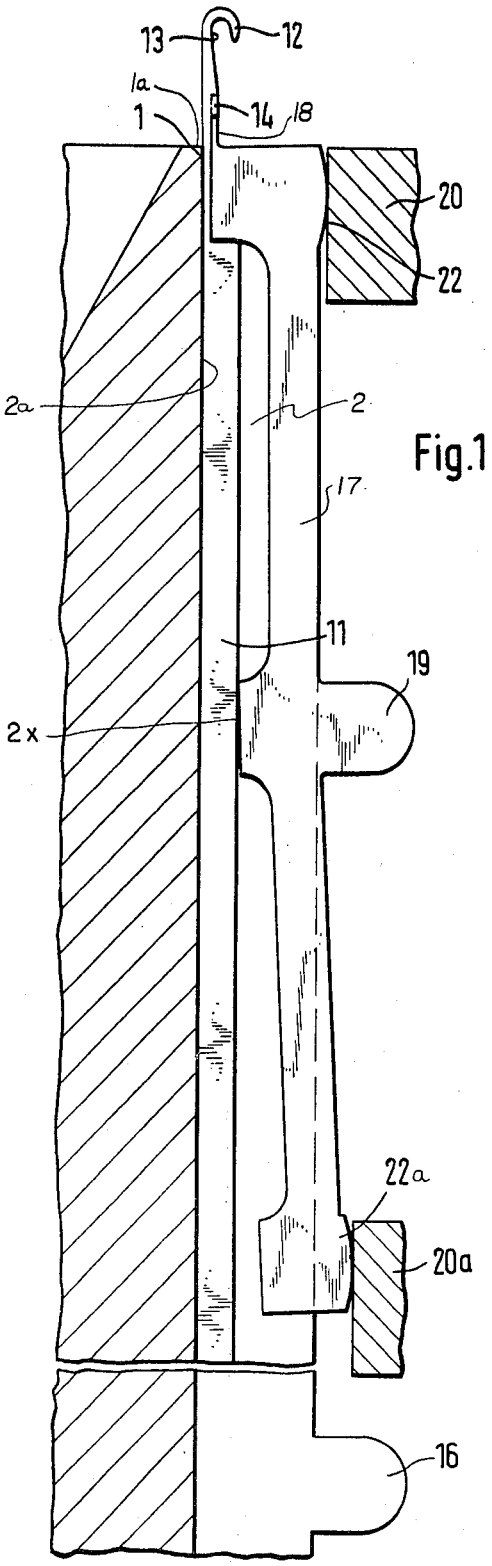
FIGS. 1 and 2 are enlarged side views of a needle and of a plate mounted in a counterpoise or seesaw fashion according to the invention, with a segment from the cylinder of a round knitting machine in different positions.
Figure 2:
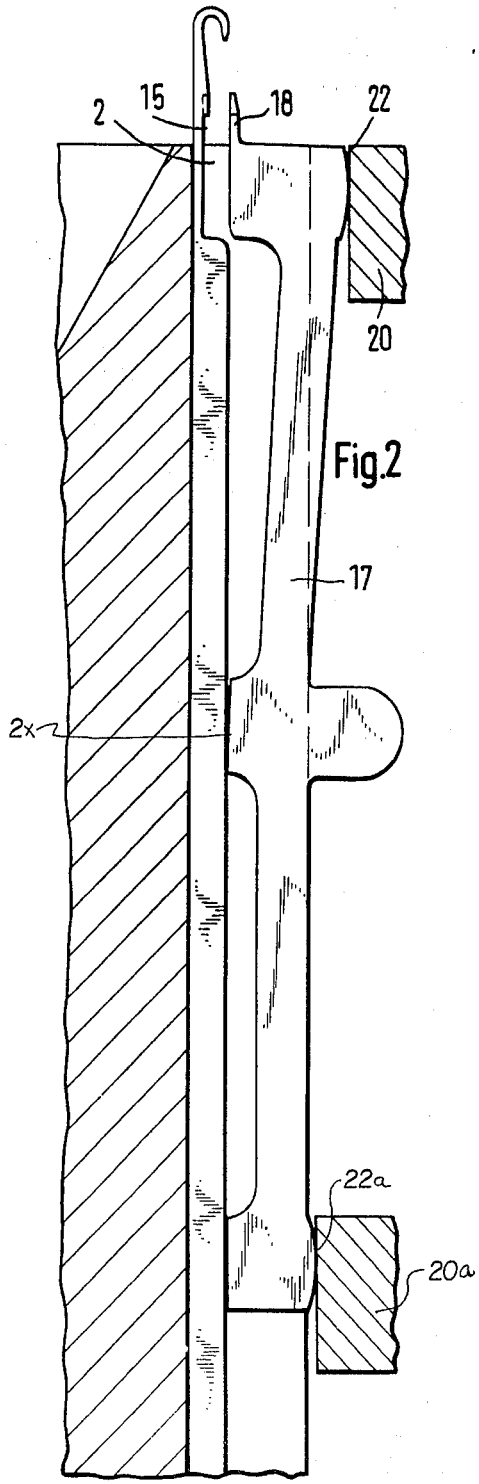

FIGS. 1 and 2 show the catch position and the knitting position respectively of a plate assigned to the needle shaft in an enlarged lengthwise cross section through a needle channel in a needle bed 1. Needle bed 1 includes an upper surface 1a. The needle channel includes lands 2 forming side boundaries and an interior wall 2*a* forming the inner most boundary thereof. On its front end, the needle 11 has a loop sinking hook 12, which goes over into a needle neck 13 and subsequently into a neck prolongation 14. A recess 15 is provided in the prolongation to take up the transport hook 18 of plate 17. The rear surface of needle 11 is flush with the interior wall 2*a* along the length thereof. Formed feet 16 and 19 are present for the lengthwise movement of the loop sinking needle 11 and the plate 17. The transverse movement of the transport hook 18 is controlled by sliding guides 20, 20*a*, which work on the sliding areas 22*a* arranged on the upper and lower end of the plate shaft respectively and thus drive the shaft around the counterpoise bearing 2x found in the area of foot 19, thereby imparting a seesaw movement to plate 17.

Figure 3:
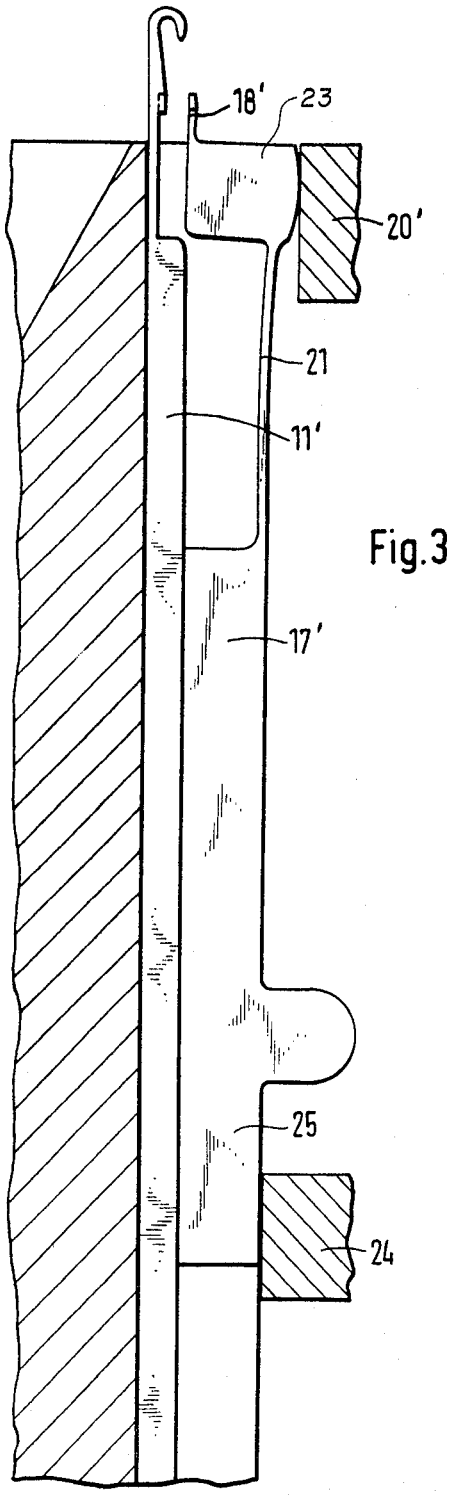
FIGS. 3 and 4 are enlarged in the same side views manner as in FIGS. 1 and 2, of an alternate embodiment of a needle and plate.

According to FIGS. 3 and 4, the plate 17' consists of a shaft having, an upper section 23 bearing the transport hook 18', and a connecting spring part 21. The transport hook 18' is prestressed by this spring part 21 in the open and knitting position shown in FIG. 3. The knitting position according to FIG. 3 is adjusted under spring effect and a counterholder by means of a ring or rail 24 on a guide section 25. The catching position according to FIG. 4 is reached according to FIG. 4 by means of the effect of sliding guides 20' on the sliding area 22'. The lower counterholder rail 24 provides for a complete juxtaposition of plate 17' on needle shaft 11' in the position according to FIG. 4.

According to FIG. 5, spring part 21'' in a contrasting manner provides for a prestress of the transport hook 18'' into recess 15'' in the needle shaft, that is to say in the catching position. The conducting over of plate 17'' into the opening of knitting position takes places with the aid of a sliding guide 20*b*, which engages behind the nose 26, in order to move the upper part 23'' of the plate away from the needle shaft in transverse direction.

The transport hook 18'' has its base in the upper section 23'' of the plate which is connected with the plate shaft by spring part 21''. The section 23'' serves also for guiding of the transport hook 18'' in the needle bed as well as for transmitting the transverse movement drive.

According to FIG. 6, the recess 15''' in the needle shaft is designed as a lengthwise groove, in order to completely take up its tapered upper end section. An example for the groove form of the recess 15''' is shown from FIG. 7, which also shows that the upper section 23''' and the transport hook 18''' are narrower than the needle channel formed by the crosspiece 2. Although this design form guarantees a favorable conducting over of the needle neck to the transport hook, in certain cases the danger exists that the thread will be drawn into the needle channel with the downward movement of the plate.

With the design form according to FIGS. 8 to 10, the transport hook 18*a* and the upper section 23*a* of the plate have the same thickness as the needle shaft, so that the thread or stitch parts cannot unintentionally get into the needle channel. The upper end of the recess 15*a* namely the end closest to hook 12x forms an oblique boundary wall 27. The free or distal end of the transport hook 18*a* exhibits a complementary obliquely running front surface for complete reception in recess 15*a*. This design form facilitates the transition of the stitch from the needle neck prolongation 14*a* to the transport hook 18a. Due to the equal thickness of the transport hook and the needle shaft, the pulling of the new thread through a uniformly widened stitch is facilitated as is the sure movement of the old stitch with the backward movement of plate 17*a*. The open recess 15*a* is self cleaning and prevents the settling of fiber sediment.

The arched transition to the transport hook 18''' and 18*a* shown in FIGS. 6 and 9 on the upper side of section 23''' and 23*a* should indicate that many practical forms are possible here, in order to achieve a largely smooth-flowing conducting of the thread and stitch. Moreover, the transition serves the purpose that the spring property of the transport hook 18''' and 18*a* is improved with its frequent stop movements against the needle shaft and is maintained for a longer time.

In case of the design form according to FIGS. 11 and 12, a short groove 28 is formed in the needle neck prolongation 14*b*, which forms the transition into the recess 15*b* extending over the entire needle shaft width. By means of this, a major portion of the transport hook 18*b* and the upper section 23*b* can be designed in full needle thickness. The free end of the transport hook is tapered for taking up within the groove 28 and according to FIG. 12 is bent slightly in the direction of the groove base.

FIG. 13 shows the open knitting position of the arrangement according to FIG. 12 moreover the loose engagement of the mutual coupling surfaces, formed by the recess 29 in section 23 of the plate as well as by the projection 30 on the shaft of needle 11*b*. The toothed engagement between needle 11*b* and plate 17*b* as shown in FIG. 12 is necessary for carrying out certain knitting operations and designs. For simple fabrics, it can suffice if, with the upward movement of the needle, the plate, firmly meshed with it for a certain area, is taken along. For this purpose it would suffice to provide an upper shoulder only on the needle and on the plate a stop face sitting in the way of the shoulder.

In the case of round knitting machines, system on system are lined up without interruption, so that sliding guides are provided to limit the spring path over the entire circumference. Since in the case of flat knitting machines the lock parts move over the needle bed, the sliding guides can work on the section 23*b* bearing the transport hook 18*b* only during the knitting operation. The limiting of the spring path independent of the sliding guides can take place in the case of round knitting machines by means of a ring 32 and in the case of flat knitting machines by means of a rail 32, which is placed in grooves 2*b* formed in the lands 2 forming the needle channels (FIG. 13). FIG. 14 shows an alternative arrangement for limiting the spring path of the transport hook by replacing ring 32 of FIG. 13 with rearward bends 34 in the upper area of lands 2 of the cylinder or needle bed.

According to FIG. 15, another ring (round knitting machine) or a rail 35 (flat knitting machine), which replaces ring 32 or rail 32 of FIG. 13, is provided over the sliding guide 20*c* to limit the spring path of the plate. Limiting ring 35 and sliding guide 20*c* thus work in common on the sliding areas 22*c* of plate 17*c*. By selectively actuating individual needles for catching or for knitting, we have many design possibilities, where the control is carried out by means of several sliding guides in the knitting system and sliding areas belonging thereto on plates.

To illustrate a practical concept of stitch forming elements in a dial arrangement as shown in FIGS. 16 and 17, FIG. 16 shows a plate 17*d* having a foot 19*d*, a prestressed spring section 21*d*, a transport hook 18*d* and an upper portion 23*d* which includes a single outwardly projecting gliding surface 22*d*. Positioned adjacent to upper portion 23*d* are a pair of sliding guides 20*d* and 36*d*. The surface of guide 20*d* adjacent to that of gliding surface 22*d* is contoured along its length. The surface of guide 36*d*, adjacent to the selection of upper portion 23*d* having no projecting gliding surface, is substantially flat along its entire length.

As the gliding surface 22*d* is moved along the contoured surface of guide 20*d*, transverse motion is imparted to upper portion 23*d* of plate 17*d* so as to cause engagement and disengagement with a corresponding needle (not shown). During this period of movement, the transverse motion of upper portion 23*d* is unhindered by the flat surface of guide 36*d*. In this manner, a stitch may be formed as will be apparent when taken in conjunction with the description of FIGS. 20–25 hereafter described in detail.

In FIG. 17, an upper portion 23*p* of plate 17*d* has second outwardly projecting gliding surface 22*d* which is adjacent to the flat surface of guide 36*d*. Plate 17*d* may, for example, be associated with a needle of an adjacent channel with respect to that as shown in FIG. 16. As gliding surfaces 22*d* move along the length of guides 20*d* and 36*d*, upper portion 23*p* of plate 17*d* remains in engagement with its corresponding needle (not shown) and transverse motion of upper portion 23*p* is prevented. This is due to the projecting gliding surface 22*d*, adjacent to the flat surface of guide 36*d*, remaining in contact with the flat surface of guide 36*d* during the entire course of travel along the length of the surface of guide 36*d*. Since in this example, upper portion 23*p* is prevented from transverse motion and remains in the closed or catch position potion with its corresponding needle (not shown), no new stitch may be formed however an additional thread may be caught. If a new stitch is to be formed by the arrangement as shown in FIG. 17, that is, by a plate having two gliding surfaces 22*d*, the guide 36*d* must be retracted from its adjacent gliding surface 22*d* so that tranverse motion with respect to upper portion 23*p* is permitted. By incorporating several gliding surfaces 22*d* and corresponding sliding guides, a great number of differing fabric designs are possible.

FIGS. 18 and 19 show alternative space saving designs of plates used in connection with rib dials. In FIG. 18, foot 19*e* is made integral with gliding surface 22*e* of upper portion 23*e*. Foot 19*e*, as previously described, is used to control longitudinal movement of the plate while gliding surface 22*e* controls transverse movement thereof. In addition, prestressed spring portion 21*e*, which connects upper portion 23*e* with plate shaft 17*e*, may be joined to plate shaft 17*e* near the surface of plate shaft 17*e* which lies adjacent to the needle assembly (not shown), as contrasted to the embodiment of FIGS. 3 and 4 wherein spring 21 is joined to the shaft of plate 17' near the surface of plate 17' opposite from the surface directly adjacent to needle shaft 11'.

In FIG. 19, plate shaft 17*f* and upper portion 23*f* are integral with one another while prestressed spring portion 21*f* is joined to plat shaft 17*f* at its end opposite upper portion 23*f*.

FIGS. 20 to 25 illustrate the most important method steps. According to FIG. 20, the transport hook 18*g* has grasped the head 40 of the last loop and by means of its transverse movement, it has formed the stitch out to full size. The new thread 41 is laid in the loop sinking hook 129 which is open on one side.

Figure 21:
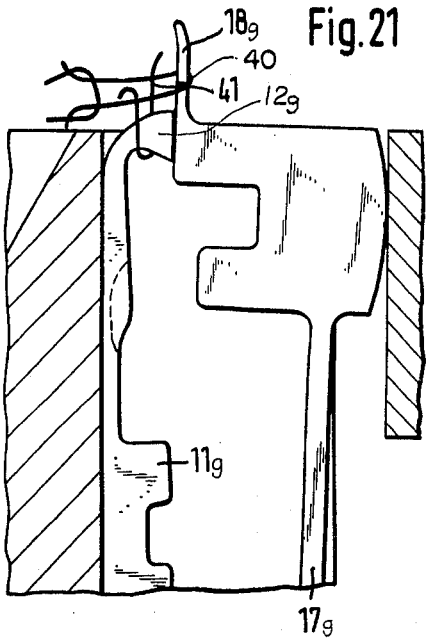

FIG. 21 shows the beginning of pulling through of the new thread 41 with the retraction movement of the loop sinking hook 12*g* through the stitch held on the transport hook 18*g*. The plate 17*g* with the transport hook 18 remains in its uppermost stroke position above the knocking over plane.

Figure 22:
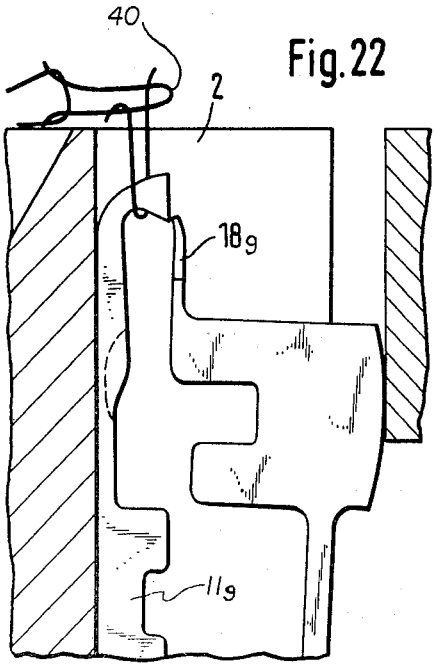

The loop sinking operation is concluded in the condition according to FIG. 22. Essentially, the hook and the plate have reached their lower end positions. The last formed stitch 40 has been stripped from transport hook 18*g* and is moved on to the needle bed (in the case of a circular knitting machine, the stitch is moved onto the upper surface of the cylinder) by the retraction movement of the plate and its transport hook 18*g*.

Figure 23:
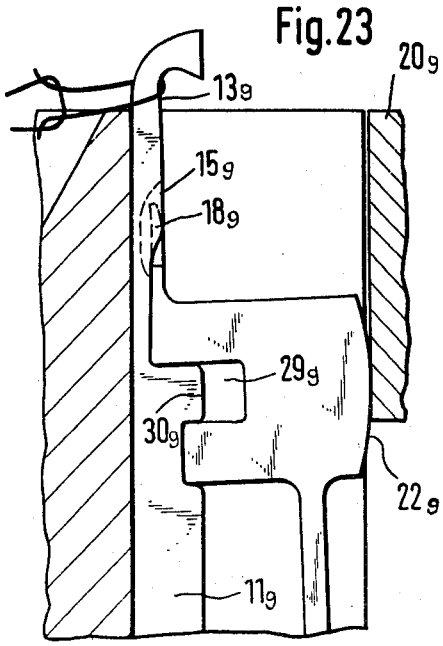
Figure 28:
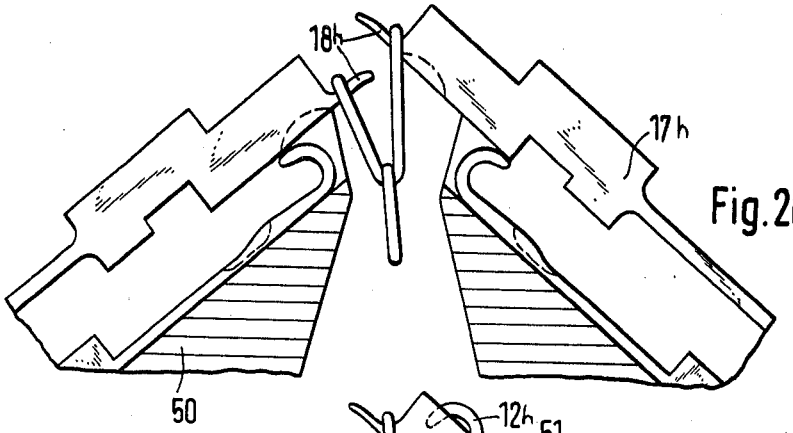

In the condition according to FIG. 23, the needle 11*g* has already moved upward by a certain distance, so that the loops of the pulled through thread lying around the hook now surrounds the needle neck 13*g* as a stitch. The coupling parts, the recess 29*g* and the projection 30*g* of the plate or needle stand opposite each other and are brought into mesh in mutual toothing, after the sliding guide 20*g* effects the transverse movement of the plate over the surface 229, whereby in addition to the coupling mesh, the transport hook 18*g* is laid into the recess 15*g* on the needle shaft. During the further forward movement of both stitch forming elements with the aid of foot (not shown, but see 16 of FIG. 1) of the loop sinking needle 11*g*, the newly formed stitch glides according to FIG. 24 under the effect of the withdrawal of the goods and the own weight of the mesh ware over the lengthening 14*g* of the needle neck onto the transport hook 18*g*. In one system, if the transport hook remains in the position shown in FIG. 24 under the effect of the sliding guide 20*g* during the cycle of the needle, then another thread is inserted without forming a stitch. Thus this position is designated as catch position.

Due to the transverse movement of the transport hook 18*g* or of the upper section 23*g* of the plate shown in FIG. 25, the stitch which is seized last with holding back of the previous loop head is brought into knitting position.

Throughout the method steps of FIGS. 20–25, it should be noted that needle 11*g* longitudinally reciprocates in a direction parallel to the interior wall 1*x*. Needle 11*g* never moves transversely with respect to interior wall 1*x*. Transverse movement of plate 17*g* occurs at its most advanced or forwardmost or most retracted longitudinal stroke positions, at which time relative longitudinal movement between needle 11*g* and plate 17*g* has ceased.

FIG. 26 shows that the loop sinking of the new loops need not occur, as was usually the case, by drawing in the new thread between the crosspiece 2*g* of the needle channel. Rather the stitch hung on the transport hook 18*g* is in a position to form the drawing in edge itself, all the more the stitch is held in a tightening position. The loop sinking than takes place below the stitch in free space 37. In this manner, we can achieve extremely fine spacings, while in the case of circular knitting machines the guides for the plates are easier to accommodate because they are found on a large diameter.

In the view according to FIG. 27, the lock paths for controlling the needle and plate feed and a sliding guide are illustrated in enlarged manner. The movement of the needle feet through the system is indicated by arrows. The lock parts 43 and 44 form a unit and in order to shift the loop sinking depth are shiftable by the dimension X. The lock parts 45, 46, 47 and 48 likewise form a unit which do not need to be shifted. The forward movement of the needle is controlled by lock parts 45, 46, the backward movement of the plate is controlled by lock part 47 and the plate transverse movement is controlled by the sliding curve 48 (20*g* for example in FIG. 24). The transverse movement for coupling the plates and coupling the transport hook with the needle takes place within a standstill area Y for the lengthwise movement of the needle. During area Z, the coupling is maintained with the common forward thrust of needle and plate, until the transport hook 18 can spring back into knitting position. If one supplements the lock part 46 by an additional curve 49 for controlling the plate upward movement, one can dispense with the physical coupling between needle and plate, whereby then the standstill area Y is dispensed with.

In FIG. 27, the lock parts have been shown to illustrate the elements responsible for controlling longitudinal and transverse movement of the needle and the longitudinal and transverse movement of the plate during the stitch formation steps as previously described in conjunction with FIGS. 20–25. Since the plate 17*g* in FIGS. 20–25 has been illustrated as the type having a spring biased upper portion 23*g* (also similar to the embodiment shown in FIGS. 3 and 4), the sliding curve or guide element 48, corresponding to 20*g* in FIGS. 20–25, is solely responsible for transverse movement of the upper portion of the plate including its transport hook into and out of engagement with the needle.

FIG. 27*a* shows the sliding curve or guide element 48 of FIG. 27 as having lowered and raised camming surfaces 48*a* and 48*b* respectively for effecting the transverse movement as described above.

FIG. 27*b* shows an alternative embodiment of lock part 46 of FIG. 27, for use with a plate having a counterpoise bearing arrangement as described in conjunction with FIGS. 1 and 2. In this arrangement, both guide elements 48 as shown in FIG. 27*a*, as well as guide element 46 as shown in FIG. 27*b*, would be utilized. Elements 48 and 46 would correspond to guide elements 20 and 20*a* respectively in FIGS. 1 and 2, in that they would control transverse movement of the upper and lower ends of plate 17 by means of camming engagement with sliding areas 22 and 22*a* respectively. Thus, as shown in FIG. 1, when transport hook 18 is in the engaged position, sliding area 22 would be riding upon upper cam surface 48*b* of element 48 while sliding area 22*a* would be riding upon lower cam surface 46*a* of element 46. Conversely, as shown in FIG. 2, when transport hook 18 is in the disengaged position, sliding area 22 would be riding upon lower cam surface 48*a*, while sliding area 22*a* would be riding upon upper cam surface 46*b* of element 46. Additionally, surfaces 48*a*, 48*b*, 46*a* and 46*b* each have curvature corresponding to the adjacent needle cylinder periphery.

If one produces the plate 17 in two parts so that each half exhibits no more than the half shaft thickness of the loop sinking needle, then with the use of the invention a takeup operation occurring with a flat knitting machine is possible, which will be subsequently described. According to FIG. 28, the last stitches are suspended on the transport hook 18*h* of two needle beds 50 arranged opposite each other. The giving over right transport hook moves so far forward that the stitch to be given over hangs approximately in the middle of the free opening between both needle beds.

Figure 29:
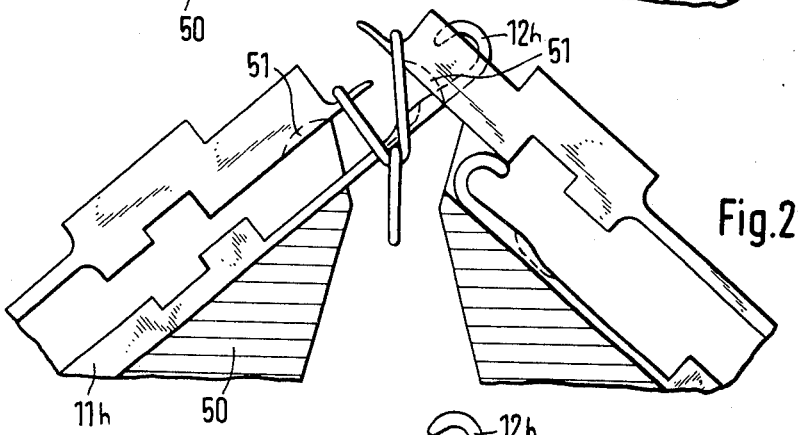
Figure 30:
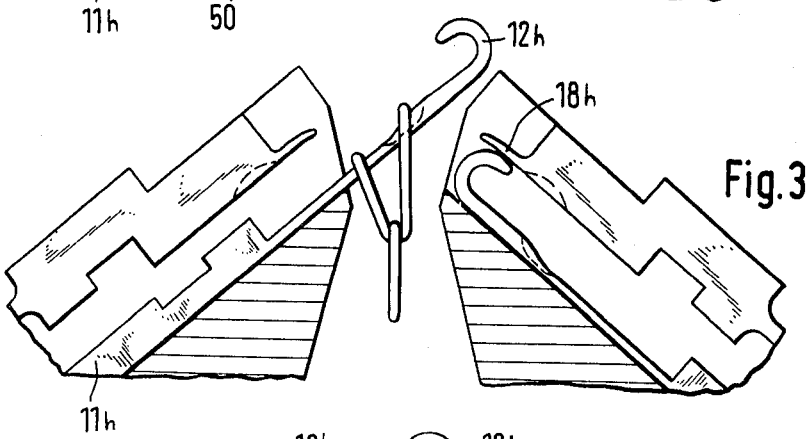

According to FIG. 29, the hook head 12*h* of the taking over loop sinking needle penetrates between both stitches and spreads the halves of the two part plate, which at this place contain moon-shaped introduction phases 51 on their inside surfaces. According to FIG. 30, the giving over transport hook is drawn back so that both stitches are found on the one loop sinking needle 11*h*. Subsequently, as shown in FIG. 31, both stitches arrive on the taking over transport hook 18*h*.

In the case of the arrangements for chain knitting and loop sinking machines shown in FIGS. 32 and 33, the needles 11*i* and plates 17*i* with their rear shaft parts are mounted in bars, which are not shown. To achieve the movements necessary for forming the stitch, the needle and plate bars must move up and down in the direction of the arrows. A knocking over comb 54 engaging between neighboring needles with their inner pressing surfaces 55, on which the sliding places 22*i* lie on the upper sections 23*i* of the plate, can be used for its transverse movement. FIG. 32 shows the point in time before the beginning of a new loop row and FIG. 33 before ending of same.

In a section, FIG. 34 shows the top view on the knocking over comb 54 with press surfaces 55 for controlling the transverse movement. Recesses 56 are provided on the upper part of the knocking over comb in the area of the thread taking in. According to FIG. 35, it is conceivable that the upper side of the knocking over comb 54 be additionally provided with plate hooks 57 which effectively hold back the fabric with the thrusting forward of the needles.

According to FIG. 36, a plate 17*j* shown as an example in natural size is fastened with its shaft part in a bar 59. In its lower area, the bar is rotatable around a transverse movement of the plate. The conventional plates and eye pointed needles are used for loop sinking of the new thread and for guiding the warp needles.

I claim:

1. A knitting machine comprising:

(a) a needle bed including an upper surface, (b) a plurality of longitudinally extending channels in said needle bed, each of said channels including longitudinally extending lands forming side boundaries and a longitudinally extending interior wall forming the innermost boundary thereof, (c) a hooked knitting needle positioned in each of said channels and having a surface flush with said interior wall, (d) a plate associated with each of said needles and guided in the same channel as its associated needle, (e) said plate having a longitudinally extending transport hook directed toward the hook of said needle, (f) said needle including a shank portion having a recess therein below said hook of said needle for receiving said transport hook of said plate, (g) said needle being movable longitudinally only with respect to said channel in said needle bed, (h) said plate being movable longitudinally and transversely with respect to said associated needle, (i) means for controlling the longitudinal movement of said needle, (j) means for controlling the longitudinal movement of said plate independent from said means for controlling the longitudinal movement of said needle, (k) means for controlling the transverse movement of said plate, (l) said needle having longitudinal movement only in a direction parallel to said longitudinally extending interior wall of said channel, (m) said plate having transverse movement occurring only at its most advanced and most retracted longitudinal stroke positions at which time relative longitudinal movement between said needle and said plate has ceased, (n) said plate causing widening of a stitch formed therearound by the transverse movement of said plate at the completion of its advanced longitudinal stroke.

2. A knitting machine as in claim 1 and wherein:

(a) said transverse movement controlling means comprises sliding guide means engaging portions of said plate.

3. A knitting machine as in claim 2 and wherein:

(a) said plate includes a shaft portion having a counterpoise bearing thereon in engagement with said shank portion of said needle, and (b) said sliding guide means act upon the opposite ends of said plate with respect to said counterpoise bearing for generating seesaw movement of said plate and thereby transverse movement of said plate.

4. A knitting machine as in claim 3 and wherein:

(a) said portions of said plate include projecting gliding surfaces.

5. A knitting machine as in claim 1 and wherein:

(a) said plate includes a laterally projecting foot thereon and said means for controlling the longitudinal movement of said plate engaging said foot for directing longitudinal movement of said plate.

6. A knitting machine as in claim 1 and wherein:

(a) said needle shank portion includes a laterally projecting foot thereon and said means for controlling the longitudinal movement of said needle engaging said foot for directing longitudinal movement of said needle.

7. A knitting machine as in claim 1 and wherein:

(a) said recess in said shank portion of said needle having an oblique boundary wall at the end closest to said hook of said needle, and (b) said transport hook of said plate having a distal end complementary to said oblique boundary wall for complete reception in said recess of said needle shank.

8. A knitting machine as in claim 7 and wherein:

(a) said shank portion of said needle and said transport hook having substantially the same thickness.

9. A knitting machine as in claim 1 and wherein:

(a) said plate having a shaft portion, an upper portion including said longitudinally extended transport hook, and a spring portion connecting said upper portion with said shaft portion, (b) said spring portion biasing said upper portion including said transport hook away from said needle, and (c) said means for controlling transverse movement of said plate acting upon said upper portion for urging said transport hook into engagement with said needle recess.

10. A method for forming a stitch with at least one continuous thread comprising:

(a) catching a thread by the hook of a knitting needle during its most advanced longitudinal stroke position, (b) holding fast a previously formed stitch by the transport hook of a plate, (c) moving said thread rearwardly through said previously formed stitch by the longitudinal retraction of said needle thereby forming a new stitch around the shaft of said needle, (d) releasing said previously formed stitch above said retracted hook of said needle by retracting said plate, (e) moving said plate transversely toward said needle causing engagement of said plate and said transport hook with said needle.

(f) advancing said needle with said engaged plate and transport hook to said needle's most advanced stroke position, and (g) widening said new stitch to a size sufficient to allow subsequent retraction of said needle therethrough by moving said plate substantially perpendicular from said needle shaft while said needle shaft is in its most advanced longitudinal stroke position prior to the subsequent retraction of said needle.

* * * * *